United States Patent [19]

Mizukami et al.

[11] Patent Number: 4,886,547

[45] Date of Patent: Dec. 12, 1989

[54] POWDER MANUFACTURING APPARATUS AND METHOD THEREFOR

[75] Inventors: Hideaki Mizukami; Kentaro Mori; Akichika Ozeki; Takaho Kawawa; Yuji Sugitani; Hirokazu Nomura; Tadashi Fujioka; Hirotaka Nakagawa, all of Chiyoda, Japan

[73] Assignee: Nippon Kokan Kabushiki Kaisha, Tokyo, Japan

[21] Appl. No.: 204,426

[22] PCT Filed: Sep. 17, 1987

[86] PCT No.: PCT/JP87/00687

§ 371 Date: May 16, 1988

§ 102(e) Date: May 16, 1988

[87] PCT Pub. No.: WO88/01919

PCT Pub. Date: Mar. 24, 1988

[30] Foreign Application Priority Data

| | | | |
|---|---|---|---|
| Sep. 19, 1986 | [JP] | Japan | 61-221343 |
| Feb. 20, 1987 | [JP] | Japan | 62-37064 |
| Feb. 26, 1987 | [JP] | Japan | 62-41323 |
| Apr. 23, 1987 | [JP] | Japan | 62-98679 |
| Apr. 23, 1987 | [JP] | Japan | 62-98682 |
| Apr. 28, 1987 | [JP] | Japan | 62-103102 |
| Apr. 28, 1987 | [JP] | Japan | 62-103104 |
| Jul. 10, 1987 | [JP] | Japan | 62-227328 |
| Sep. 10, 1987 | [JP] | Japan | 62-227326 |
| Sep. 10, 1987 | [JP] | Japan | 62-227327 |
| Sep. 10, 1987 | [JP] | Japan | 62-227325 |
| Sep. 10, 1987 | [JP] | Japan | 62-227329 |
| Sep. 10, 1987 | [JP] | Japan | 62-227330 |

[51] Int. Cl.[4] ..... B22F 3/00

[52] U.S. Cl. ..... 75/0.5 C; 425/6; 75/10.23

[58] Field of Search ..... 425/6, 8; 75/0.5 C, 75/10.23, 10.26; 264/8, 10

[56] References Cited

U.S. PATENT DOCUMENTS

| | | | |
|---|---|---|---|
| 2,189,387 | 2/1940 | Wissler | 264/10 |
| 2,310,590 | 2/1943 | Marette | 75/0.5 C |
| 2,897,539 | 8/1959 | McMillan | 264/8 |
| 3,829,538 | 8/1974 | Darmara et al. | 264/10 |
| 3,887,667 | 6/1975 | Clark | 264/8 |
| 4,374,075 | 2/1983 | Yolton et al. | 264/8 |
| 4,610,718 | 9/1986 | Araya et al. | 75/0.5 C |

FOREIGN PATENT DOCUMENTS

| | | |
|---|---|---|
| 54-95965 | 7/1979 | Japan . |
| 59-59812 | 4/1984 | Japan . |
| 59-110705 | 6/1984 | Japan . |
| 60-52502 | 3/1985 | Japan . |
| 60-70110 | 4/1985 | Japan . |

OTHER PUBLICATIONS

On the Rapid Solidificatiion of Superalloys, A.R. Cox, L. B. Moore, E. C. van Reuth.

Mathematical-Physical Considerations Regarding the Production of Metal Powders for Powder Metallurgy (Part I)-H. Schmitt.

G. Friedman, AGARD Conf. Proc. (1976) SCI pp. 1-2 to 1-5.

*Primary Examiner*—L. Dewayne Rutledge

*Assistant Examiner*—David Schumaker

*Attorney, Agent, or Firm*—Frishauf, Holtz, Goodman & Woodward

[57] ABSTRACT

The present invention provides a method of efficiently and stably manufacturing a high-purity metal powder of a desired particle size, which is used for powder metallurgy or the like, by generating arc 18 between electrodes 12 and 13 to melt the distal end portions of the electrodes, causing droplets 19 of the molten metal to drop onto rotating disk 14, scattering the dropped droplets by a centrifugal force, thereby cooling the droplets, and an apparatus for the same.

77 Claims, 6 Drawing Sheets

POWDER MANUFACTURING APPARATUS AND METHOD THEREFOR

TECHNICAL FIELD

The present invention relates to an apparatus for manufacturing a metal powder used in powder metallurgy or the like and a method for the same.

BACKGROUND ART

Powder metallurgy is a technique for manufacturing a metal product or ingot by charging a metal or alloy powder into a mold, pressure-molding the powder, and sintering the molded product. Powder metallurgy is advantageous in that segregation of components does not occur, a product can be obtained from a material difficult to work, a member having a very fine crystal structure can be obtained, secondary machining can be omitted, and the like. These advantages cannot be obtained using a technique for manufacturing a metal product or ingot by melting a metal.

Three typical methods of manufacturing a powder of a high alloy, a Ti alloy, and the like will be described.

A. R. Cox, J. B. Moore, E. C. Van Reuth; Int. Symp. Superalloys, 3rd discloses a technique in which a metal is melted in a container by an RF current, the molten metal is dropped onto a disk rotated at a high speed, the dropped molten metal is scattered by a centrifugal force, and the scattered metal particles are rapidly solidified with a cooling medium having a high thermal conductivity such as hydrogen gas and helium gas.

G. Friedman; AGARD Conf. Proc., (1976) SCI discloses a technique in which an arc is generated between a nonconsumable electrode and a consumable electrode rotated at a high speed, the metal droplets generated by the molten consumable electrode are scattered by a centrifugal force, and the scattered metal droplets are cooled, thereby obtaining a metal powder.

H. Schmit; Powder Metall. Int. 11(1976) 1, p17 discloses a technique in which an arc is generated between a water-cooled crucible and an electrode to thermally melt the distal end portion of the electrode by the heat of the arc, the molten droplets dripped into the crucible being rotated at a high speed to scatter and cool them, thereby manufacturing a powder.

In the method of A. R. Cox, since the molten metal is reserved in the container, impurities can be mixed in the molten metal from the container. Therefore, a high-purity powder cannot be manufactured.

In the method of G. Friedmean, since the droplets are scattered by the centrifugal force obtained by the rotating consumable electrode, when a powder having a small particle size is to be obtained, the consumable electrode must be rotated at a high speed. However, it is quite difficult to rotate the electrode at a high speed because of the electrode machining precision and an electrode rotating mechanism. When the diameter of the electrode is decreased, the electrode can be rotated at a high speed. In this case, however, the lot scale is decreased, and electrode manufacturing costs per unit volume become expensive In the method of G. Schmit, since the rotating crucible also serves as the nonconsumable electrode, it must be rotated at a high speed while it is energized. This is quite difficult because of the crucible machining precision and the crucible rotating mechanism. This problem becomes conspicuous when a metal powder having a small particle size is to be obtained because in this case a higher speed of rotation is needed.

DISCLOSURE OF INVENTION

It is a first object of the present invention to provide a powder manufacturing apparatus which can manufacture a high-purity powder which is used in a product made of a high alloy, Ti, a Ti alloy, a superalloy, and the like with a high productivity, and a method for the same.

It is a second object of the present invention to manufacture the above powder at a low cost.

It is a third object of the present invention to provide a powder manufacturing apparatus for reliably manufacturing a powder having a desired particle size, and particularly a small particle size, and a method for the same.

It is a fourth object of the present invention to provide a powder manufacturing apparatus wherein metal droplets are stably formed and are constantly dropped at a predetermined position, and a method for the same.

It is a fifth object of the present invention to provide a powder manufacturing apparatus having a small and simple droplet forming mechanism.

It is a sixth object of the present invention to provide a powder manufacturing apparatus for obtaining a rapidly cooled powder and a method for the same.

It is a seventh object of the present invention to provide a powder manufacturing apparatus for manufacturing a powder without contaminating its electrode and chamber with droplets or powder, and a method for the same.

In order to achieve the above objects, according to the present invention, an arc is generated between electrodes, at least one of which is a consumable electrode, the distal end portion of the consumable electrode is melted, the droplets of the molten metal are dropped on a rotating disk, and the droplets are scattered by utilizing the centrifugal force of the disk and cooled, thereby obtaining a metal powder.

According to the powder manufacturing apparatus and the method for the same of the present invention, the electrodes have only a function to generate an arc for forming droplets and do not have a function to scatter the droplets. Therefore, the electrodes need not be rotated at a high speed to scatter the droplets, and a complex rotating mechanism need not be mounted to the electrode. The electrode machining precision need not be strict. An electrode having a large diameter can be used, and the productivity can be improved. Also, according to the present invention, the disk has only a function to scatter the dropped droplets by utilizing the centrifugal force and does not have a function to generate an arc with the electrode. Therefore, the disk machining precision need not be high and the rotating mechanism is simplified.

BEST MODE OF CARRYING OUT THE INVENTION

Figure 1:
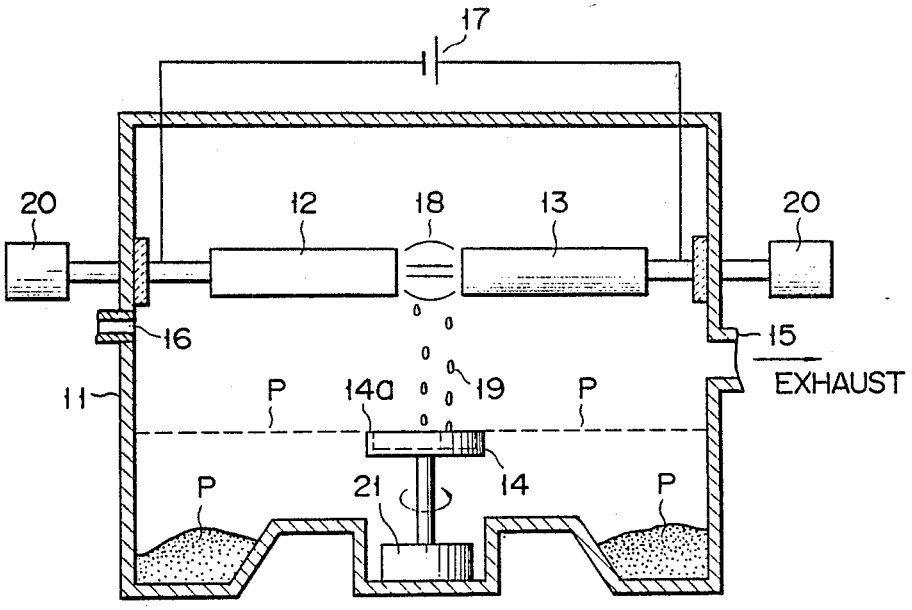
FIG. 1 is a sectional view schematically showing an embodiment of the present invention.

Preferred embodiments of the present invention will be described with reference to the accompanying drawings. FIG. 1 shows an embodiment of the present invention. In the apparatus shown in FIG. 1, electrodes 12 and 13 are arranged in chamber 11 and a disk 14 is arranged under electrodes 12 and 13. Chamber 11 has gas exhaust port 15 connected to an exhaust means (not shown) such as a vacuum pump so that its interior can be kept at a reduced pressure. Chamber 11 also has gas inlet port 16 so that its interior can be held at an inert gas atmosphere such as argon or helium gas. Electrodes 12 and 13 are consumable electrodes having substantially the same composition as that of the powder to be manufactured. Electrodes 12 and 13 are horizontally, coaxially arranged and distant from each other at a predetermined gap. Electrodes 12 and 13 are connected to power source 17. Upon reception of a current from power source 17, arc 18 is generated between electrodes 12 and 13, the distal end portions of the electrodes 12 and 13 are melted by the arc heat to form metal droplets 19, and droplets 19 are dropped. Electrodes 12 and 13 are mounted on electrode drivers 20 provided outside chamber 11. As the distal end portions of electrodes 12 and 13 are melted, electrodes 12 and 13 are moved by driving means 20 toward their distal ends such that the gap between them is constant.

Disk 14 is arranged at a drop position of droplets 19 formed at the distal end portions of electrodes 12 and 13, and annular side wall 14*a* projects from its upper periphery. Rotating means 21 for rotating disk 14 is mounted on the lower surface of disk 14. Rotating means 21 rotates disk 14 at a high rotational frequency, e.g., 30,000 rpm. Therefore, metal droplets 19 dropped on disk 14 are scattered by the centrifugal force and cooled by the atmosphere gas, thereby obtaining a desired powder.

In this embodiment, consumable electrodes having the same composition as that of the powder to be manufactured are used as the electrodes. Therefore, impurities are not mixed in the powder from the consumable electrodes, thereby increasing the powder purity. Since both of the electrodes are consumable electrodes, the powder manufacturing speed is as high as, e.g., about 200 kg/charge. Since the droplets need not be scattered directly from the electrodes, the electrodes need not be rotated at a high speed, resulting in a simple mechanism of the powder manufacturing apparatus. Since the electrodes need not be rotated at a high speed, the electrodes can have a large diameter, resulting in a low manufacturing cost per unit volume of the electrodes.

Although not shown in FIG. 1, electrodes 12 and 13 can be slowly rotated by the rotating means in the same direction or opposite directions. With this rotation, the electrodes are uniformly melted, thereby stably generating an arc. Rotation in this case means a slow rotation capable of preventing nonuniform melting by the arc and has a completely different rotational frequency from that required for scattering the droplets. Since the rotation is slow, the conventional problems of the rotating mechanism described above do not occur.

Figure 8A:
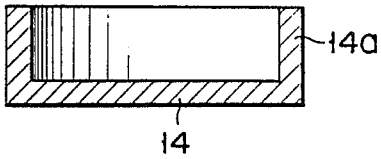
FIGS. 8A to 8F are sectional views of different disks of the present invention.
Figure 8B:
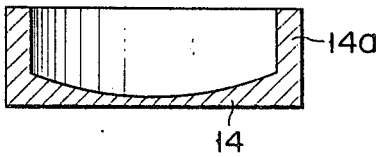
Figure 8C:
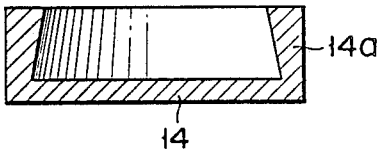
Figure 8D:
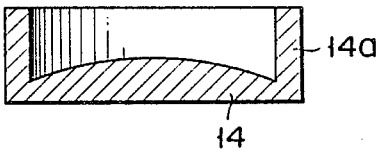
Figure 8E:
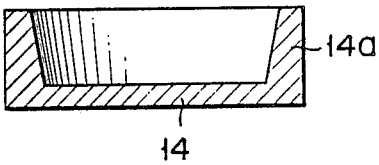
Figure 8F:
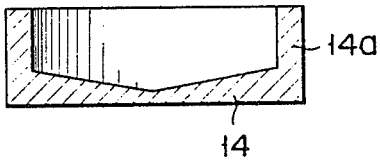
Figure 8G:
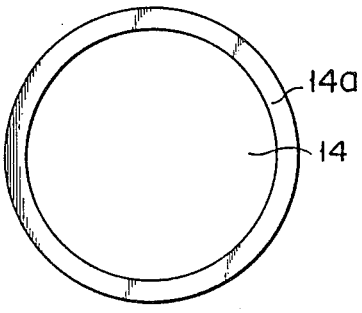
FIG. 8G is a plan view of the disk shown in FIG. 8A.

Since the disk of this embodiment has an annular side wall, it can stably scatter the droplets, thereby reliably obtaining powder having a desired particle size. More specifically, when the arc generating conditions are varied, the drop speed of the droplets formed at the distal end portions of the electrode becomes unstable, and the drop position can also be unstable. In this case, some of the droplets jump at the drop position or scatter before they reach the periphery of the disk, resulting in a powder having a larger particle size than is desired. However, with annular side wall 14*a*, droplets are prevented from jumping and are reliably scattered from the periphery of the disk. As a result, the droplet scattering state can be stabilized and powder P having a desired particle size can be stably obtained. When the rotational frequency of the disk is from 15,000 to 20,000 rpm in order to obtain a powder having a particle size of 200 μm or less, the inner diameter of the disk inside its side wall is preferably 50 to 200 mm. If the side wall is excessively low, it does not sufficiently serve as the side wall; if excessively high, the disk cannot be stably rotated at a high speed. Therefore, the height of the side wall is preferably 10 to 100 mm. The disk can have various sectional shapes as follows. For example, in FIG. 8A, the bottom surface is flat and the side wall is perpendicular to it. In FIG. 8B, the bottom surface is upwardly arcuated to project and the side wall is vertical. In FIG. 8C, the bottom surface is flat and the side wall is tapered to be upwardly narrower. In FIG. 8D, the bottom surface is downwardly arcuated to be recessed and the side wall is vertical. In FIG. 8E, the bottom surface is flat and the side wall is tapered to be upwardly larger. In FIG. 8F, the central portion of the bottom surface is deep while its periphery is shallow. FIG. 8G is a plan view of the disk shown in FIG. 8A.

Examples of the material of the disk include graphite, boron nitride, zirconium boride ($ZrB_2$), water-cooled copper, stainless steel, and the like. When a titanium powder or a titanium alloy powder is to be manufactured, the disk is preferably made of a material having the same composition as that of the powder to be obtained in order to prevent contamination from the disk or water cooled copper.

Figure 2:
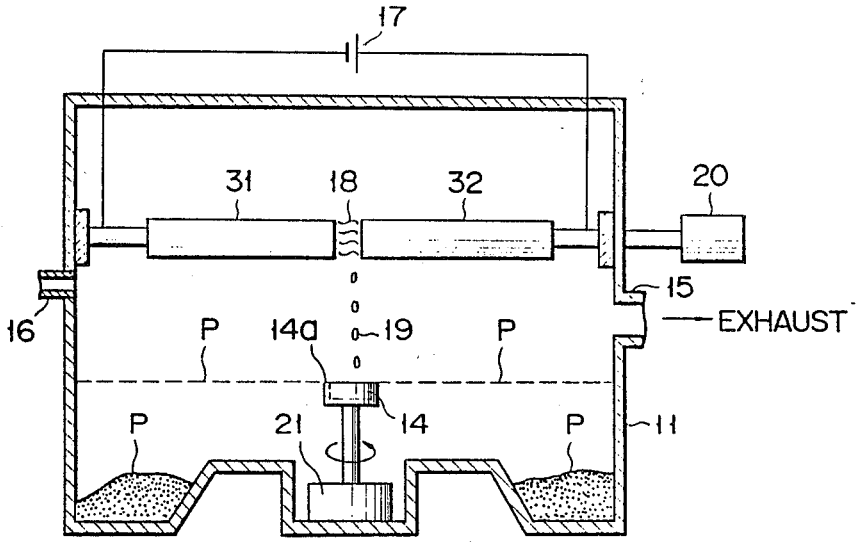
FIGS. 2 to 7 are sectional views schematically showing different other embodiments of the present invention, respectively.
Figure 3:
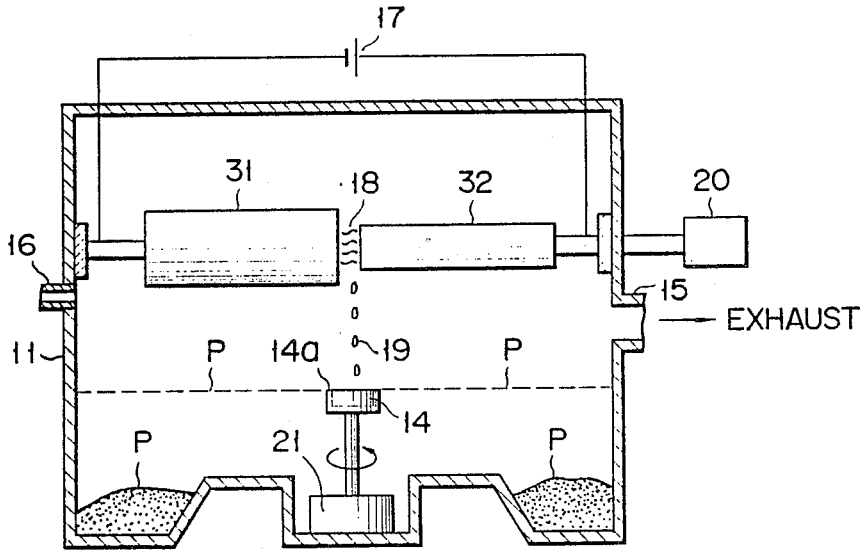

FIG. 2 shows a powder manufacturing apparatus according to another embodiment of the present invention. In FIG. 1, both of the electrodes are consumable electrodes. Meanwhile, in FIG. 2, one of the electrodes is replaced by nonconsumable electrode 31 while the other remains consumable electrode 32. With this apparatus, the productivity is lower than that of the apparatus shown in FIG. 1, and a powder is manufactured at, e.g., about 100 kg/charge. However, when an arc is generated between the electrodes to form droplets, since only the consumable electrode is consumed, the position of nonconsumable electrode 31 is not changed and only consumable electrode 32 is moved by electrode driving means 20. Therefore, in this case, only one electrode need be position adjusted, position adjustment of the distal ends of the electrodes is easier than in a case when both electrodes must be position adjusted, and the droplet drop position can be constantly stabilized. A known water-cooled copper electrode or a water-cooled tungsten electrode can be used as the nonconsumable electrode. When mixing of impurities must be minimized, nonconsumable electrode 31 is made of a material having the same composition as that of the consumable electrode, and the current density flowing across electrode 31 is set to be extremely smaller than that flowing across the consumable electrode. This can be achieved when the sectional area of electrode 31 is set to be twice or larger that of electrode 32, as shown in FIG. 3. With the apparatus shown in FIGS. 2 or 3, since the droplet drop position can be correctly controlled, the disk diameter can be decreased. As a result, the rotational frequency of the disk can be increased, and a powder having a small particle size can be obtained.

Figure 4:
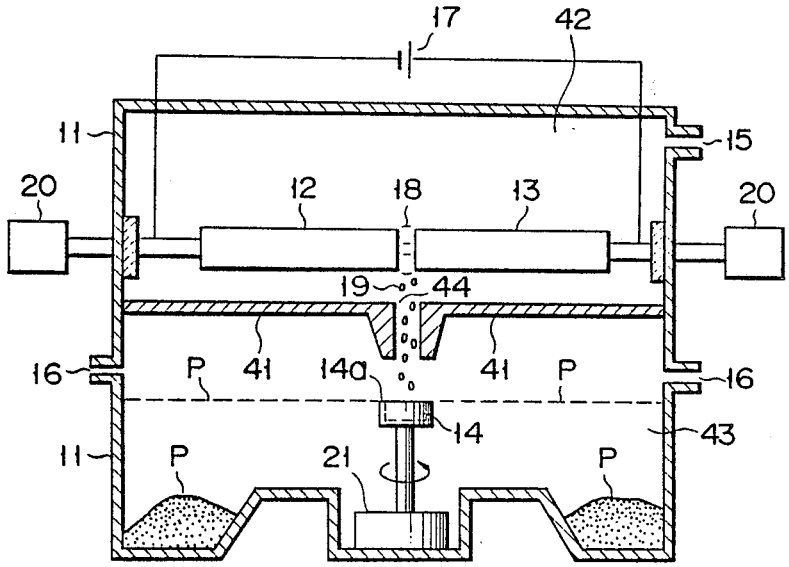

In a powder manufacturing apparatus shown in FIG. 4, chamber 11 is vertically divided by partitioning wall 41 to define droplet forming space 42 in the upper portion and droplet cooling space 43 in the lower portion. Communicating portion 44 is formed in partitioning wall 41 to allow droplets to pass therethrough while it has ventilation resistance. Electrodes 12 and 13 are arranged in droplet forming space 42. Space 42 has gas exhaust port 15 connected to an exhaust means (not shown) such as a vacuum pump so that its interior can be evacuated to a high vacuum pressure. Disk 14 is arranged in droplet cooling space 43. Space 43 has a plurality of gas inlet ports 16 for introducing an inert gas such as helium gas. Even when droplet forming space 42 is at a reduced pressure, the pressure of the inert gas atmosphere of droplet cooling space 43 can be increased. Since the atmosphere ga is supplied from the plurality of gas inlet ports 16, local flow of the gas can be prevented.

The pressure of droplet forming space 42 is preferably kept at 50 Torr or less, and more preferably 10 Torr or less. The pressure of droplet cooling space 43 is preferably kept at 50 Torr or more, and more preferably 100 Torr or more.

As a means for keeping the evacuation degree of droplet forming space 42, the gas is exhausted not only through gas exhaust port 15 but also through droplet cooling space 43. As a result, the amount of atmosphere gas flowing into space 42 through communicating portion 44 can be decreased and the load on the exhaust means connected to exhaust port 15 can be decreased.

With this apparatus, since droplet forming space 42 is at a reduced pressure, arc 18 generated between electrodes 12 and 13 is stable and the formed droplets drop substantially vertically. The dropped droplets drop on disk 14 arranged in droplet cooling space 43 through communicating portion 44 formed in partitioning wall 41. The droplets dropped on disk 14 are scattered. Since the pressure of the atmosphere gas in space 43 is high, the droplet cooling efficiency is high, and the droplets are instantaneously cooled and solidified to form a rapidly cooled powder. In this manner, according to this embodiment, the pressure of the atmosphere for stably generating the arc is low while that of the atmosphere suited for cooling the droplets is high, resulting in different pressure conditions. Despite that, the respective pressures can be independently adjusted to desired values.

Figure 5:
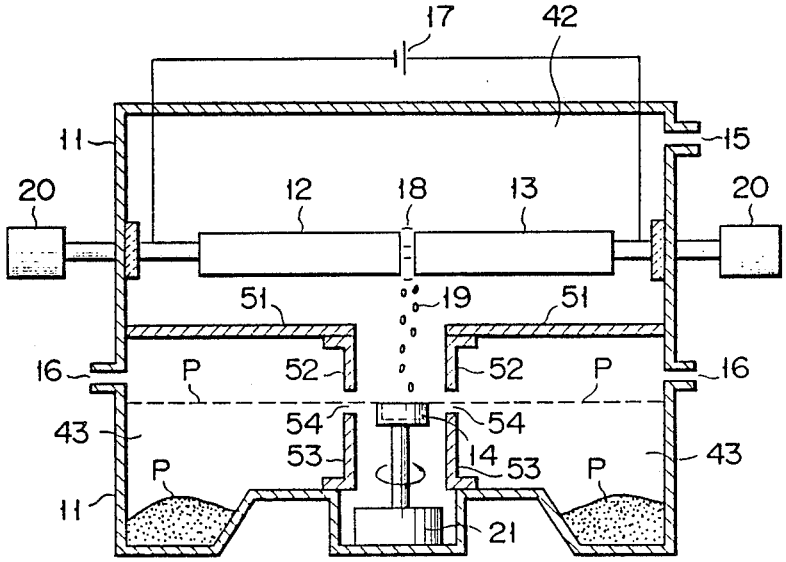

A powder manufacturing apparatus shown in FIG. 5 has, in place of partitioning wall 41 shown in FIG. 4, partitioning wall 51 arranged on a plane vertically dividing chamber 11, and a pair of vertical cylindrical partitioning walls 52 and 53 arranged to surround disk 14. Walls 52 and 53 oppose each other through a gap at a portion corresponding to a plane extending from the upper end of disk 14 and define communicating portion 54 at this gap.

In this embodiment, since no communicating portion is provided in the path from electrodes 12 and 13 down to disk 14, the droplet path can be widened. Even if the drop direction of the droplets is slightly changed, the droplets do not attach to the partitioning wall. It is preferable that partitioning walls 52 and 53 are arranged as close as possible to disk 14 so that the droplets scattering from disk 14 can pass through a narrow communicating portion.

In order to reliably keep the pressure difference between droplet forming and cooling spaces, it is preferable that the partitioning wall of FIG. 4 is combined with that of FIG. 5, i.e., communicating portions are provided both in the path of the droplets from the electrodes onto the disk and in the path of the droplets scattering from the disk, thereby increasing the ventilation resistance.

Figure 6:
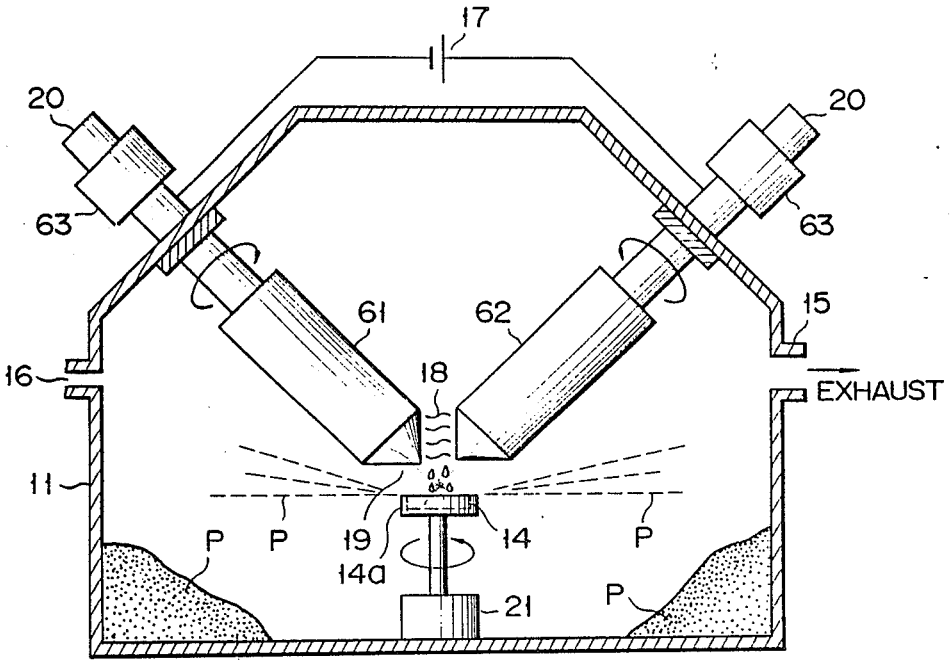

A powder manufacturing apparatus shown in FIG. 6 is the same as that of FIG. 1 except that the arrangement of the electrodes is different. In FIG. 6, a pair of electrodes 61 and 62 having the same composition as that of a powder to be manufactured oppose each other and are inclined downwardly in the same vertical plane such that lines extending from their axes intersect at an angle of, e.g., 45°. with respect to the horizontal direction. Electrode driving means 20 are mounted on electrodes 61 and 62, respectively. Electrodes 61 and 62 are driven in the directions toward their distal ends in accordance with the melting speed of their distal end portions. Electrode rotating means 63 are provided to electrodes 61 and 62, respectively. When electrodes 61 and 62 are rotated by rotating means 63 about their axes, their opposing ends are always maintained constant.

When electrodes 61 and 62 are arranged in this manner and rotated to generate an arc, their distal end portions become conical. The regions of the electrode distal end portions to generate an arc are opposite to each other when the electrodes are arranged parallel to each other. In this embodiment, however, the regions are linear. As a result, the current density is considerably increased, and arc generation can be stably maintained even when the atmosphere pressure of chamber 11 is high. When the electrodes are arranged parallel to each other, if the electrodes are moved close to the disk, the powder scattering from the disk is undesirably fused on the electrodes. In this embodiment, since the electrodes are inclined downwardly, the powder scattering from the disk can be prevented from colliding against the electrodes and being fused on them. When the electrodes are arranged to oppose each other and are inclined downwardly, an electromagnetic pinch force is generated. With the pinch force, the droplets formed from the electrodes reliably drop onto the disk even if the atmosphere pressure is high.

The present invention can be applied to the manufacture of a dispersion-reinforced alloy powder. In this case, electrodes obtained by mixing predetermined metal and nonmetallic powders at a predetermined ratio and sintering the mixture to provide an ingot are used. With this method, a dispersion-reinforced powder having no nonmetallic particle segregation can be obtained.

Furthermore, in the present invention, a high frequency (such as RF) AC power source is preferably used as a means for generating an arc between the electrodes. More specifically, when an arc is generated by supplying a DC current to the electrodes, the melting speed of the cathode is higher than that of the anode, and the center of the arc is displaced, resulting in a displaced droplet drop position. When a high frequency AC power source is used as the means for generating the arc between the electrodes, the distal end shapes and melting states of the electrodes become symmetrical, and the droplet drop position can be easily controlled. Even when the pressure in the chamber is set to, e.g., 100 Torr or higher, stable arc generation can be maintained. An AC arc is advantageous in that magnetic arc blow (droplets are affected, during dropping, by a magnetic field generated in the vicinity of the distal end portions of the electrodes) which is a defect of a DC arc does not occur.

When an AC current is used as the current to be supplied to the electrodes, the arc is sometimes extinguished during instantaneous polarity switching and cannot be generated again, particularly when the atmosphere pressure is low. However, as the AC frequency is increased, the polarity switching time is decreased, an electrode which has not been ON is turned on before the arc plasma remaining between the electrodes is extinguished, and arc discharge can be easily obtained. In this state, the problems of arc extinguishment and arc instability caused by polarity switching are solved. The RF frequency having the above effects varies depending on the material and size of the electrodes, the current density, the type and pressure of the atmosphere gas, the electrode distance, and the employed voltage waveform (e.g., a sine wave or rectangular wave), and is about 500 Hz or more. With the rectangular wave, the arc is stabilized with a lower frequency since the switching time of the rectangular wave is shorter than that of the sine wave.

Figure 7:
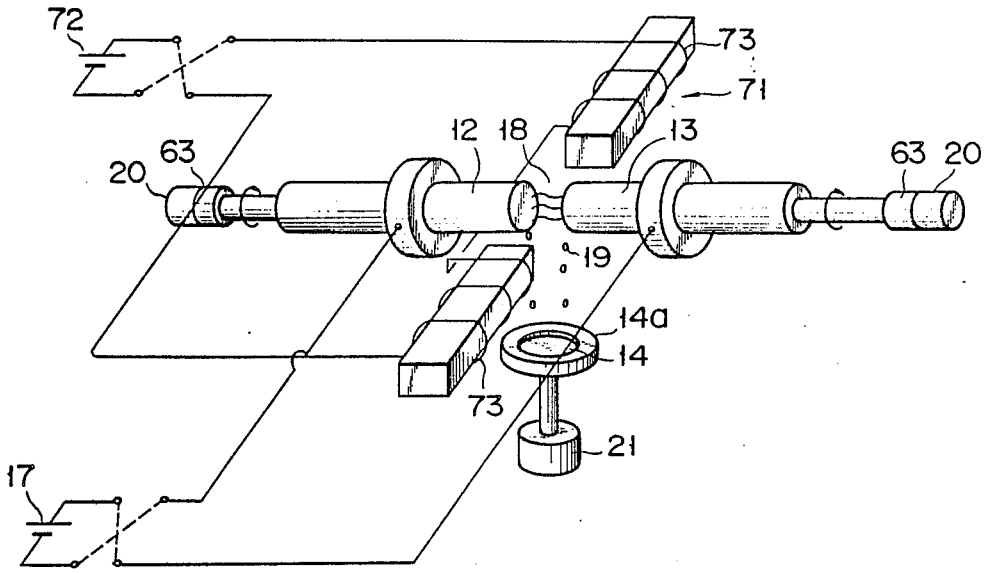

FIG. 7 shows a main part of an apparatus obtained by providing magnetic field generator 71 to the powder manufacturing apparatus shown in FIG. 1. Magnetic field generator 71 has magnetic field power source 72 and magnetic field coils 73 for applying a horizontal magnetic field to arc 18 generated by electrodes 12 and 13 in directions perpendicular to arc 18 to sandwich it. In this case, when a DC voltage is to be applied to the electrodes, a DC magnetic field is applied; when an AC voltage is to be applied, an AC magnetic field having a phase locked with that of the AC voltage is applied to the electrodes.

When a magnetic generator is operated, a vertical downward force acts on the droplets melted and dropped from the distal end portions of the electrodes. Therefore, even if the atmosphere pressure of chamber 11 is increased, the droplet can be forcibly dropped onto the rotating disk below and dropping of the droplets can be stabilized.

Regarding the directions in the description, the horizontal, perpendicular, or vertical direction need not have a geometric strictness but may include an inclination of a range allowing stable dropping of the droplets onto a desired portion on the disk.

Practical embodiments of the present invention which use the powder manufacturing apparatuses described above will be described.

EXAMPLE 1

In Example 1, the powder manufacturing apparatus shown in FIG. 1 was used.

Electrodes having a diameter of 180 mm and made of a Ti-6Al-4V alloy were obtained by VAR (Vacuum Arc Remelting) and used as the consumable electrodes. A disk having an inner diameter of 80 mm inside its side wall and a height of 15 mm was used. The disk rotational frequency was set at 20,000 rpm. A current of 5,000 A was supplied across the electrodes to melt the distal end portions of the consumable electrodes. The droplets obtained by melting were dropped onto the disk and scattered, and cooled. As a result, a metal powder having a particle size of about 150 μm was obtained. The melting speed in this case was 7 kg/min.

EXAMPLE 2

In Example 2, the apparatus shown in FIG. 1 was used and the electrodes were slowly rotated.

Columnar electrodes of 150 mm in diameter were made of a nickel-based high alloy having a composition shown in Table 1 in accordance with the VAR method.

TABLE 1

| | | (weight %) | | |
|---|---|---|---|---|
| Ni | Cr | Mo | Nb | Fe |
| 61 | 22 | 9 | 4 | 3 |

Two electrodes obtained in this manner were arranged to oppose each other and a current of 5,500 A was supplied to them while they were rotated at a rotational frequency of 2 rpm in the opposite directions, thereby generating an arc between them. In this case, the electrode melting speed was 7.4 kg/min. The disk rotational frequency was set at 15,000 rpm. Droplets obtained by melting the electrodes were dropped onto the disk and scattered around. The obtained powder had a desired particle size of about 200 μm.

EXAMPLE 3

In Example 3, the apparatus shown in FIG. 3 was used.

A pair of consumable electrodes made of a Ti-6Al-4V alloy and having a diameter of 100 mm were used. The communicating portion of the partitioning wall had a diameter of 40 mm. The disk was a flat disk having a diameter of 90 mm. The disk rotational frequency was set at 30,000 rpm. Prior to the start of powder manufacture, air was evacuated from the droplet forming space with a diffusion pump at 30,000 l/sec, and helium gas was introduced to the droplet cooling space at 4 Nl/sec. When the gas exhaust and gas introduction reached an equilibrium, the pressures in the droplet forming and cooling spaces were 7 and 90 Torr, respectively. In this gas atmosphere, a current of 3,000 A was supplied between the two electrodes to generate an arc. All droplets formed at the electrodes dropped onto the disk and scattered from the disk as fine droplets. The scattered droplets did not attach to the inner wall of chamber 11 but were accumulated in chamber 11. The particle size of the obtained powder was about 100 μm. The electrode melting speed was 4.2 kg/min.

EXAMPLE 4

In Example 4, the powder manufacturing apparatus shown in FIG. 6 was used.

Two electrodes having the same diameter and composition as those of Example 3 were prepared. These electrodes were arranged to oppose each other and inclined downwardly at an angle of 45° with respect to the horizontal direction. A current of 3,000 A was supplied between these electrodes to generate an arc between them while they were rotated at a rotational frequency of 2 rpm in the opposite directions. The electrode melting speed was 4 kg/min. The inner diameter of the chamber was 2,000 mm and the atmosphere gas was helium gas at 120 Torr. In this case, the distance between the distal ends of the electrodes and the disk was set at 70 mm. The diameter of the disk was 90 mm, the height of its side wall was 20 mm, and its rotational frequency was 25,000 rpm. The average particle size of the obtained powder was 170 μm.

EXAMPLE 5

In Example 5, a dispersion-reinforced powder was manufactured using the apparatus shown in FIG. 1.

A Ni fine powder and a TiC fine powder were formulated at a weight ratio of 100:5 and mixed by agitation for 10 minutes. Then, the resultant mixture was pressure-molded, pre-sintered, sintered in vacuum, and machined, thereby obtaining a rod-like sintered body having a diameter of 20 mm. Two sintered bodies of this type were used as electrodes. A DC voltage of 60 V and a current of 200 to 100 A were supplied between these electrodes to generate an arc. The drollets obtained by melting the electrodes were dropped onto the disk rotated at a rotational frequency of 30,000 rpm and scattered around. The obtained powder was a dispersion-reinforced alloy powder having an average particle size of 100 μm. Nonmetallic particles were uniformly dispersed in the obtained powder.

EXAMPLE 6

In Example 6, the apparatus shown in FIG. 1 was used and an RF AC current was flowed between the electrodes.

A Ti-6Al-4V alloy was melted by the VAR method to prepare consumable electrodes having a diameter of 150 mm. An RF AC current of 3,000 A and 5 kHz and having a rectangular wave was flowed between the electrodes to melt them. The disk was a flat disk having a diameter of 90 mm. The disk rotational frequency was set at 30,000 rpm. The droplets obtained by melting were dropped onto the disk and scattered and cooled. The obtained powder had a particle size of about 100 μm. The atmosphere gas in the chamber was helium gas of 500 Torr. The electrode melting speed was about 4.5 kg/min.

EXAMPLE 7

In Example 7, the apparatus shown in FIG. 7 was used.

Two electrodes having a diameter of 100 mm were prepared using a Ti-6Al-4V alloy obtained using a vacuum arc melting furnace. The two electrodes were arranged to oppose each other horizontally and a current of 3,000 A was flowed to them to generate an arc. A DC magnetic field of 200 Gauss was generated to sandwich this arc. The droplets obtained by melting the electrodes were dropped onto a disk having a diameter of 90 mm and a 15-mm height side wall and rotated at a rotational frequency of 25,000 rpm, thereby manufacturing a powder. The electrode melting speed was 4.0 kg/min and the average particle size of the powder was 170 μm. The chamber had a diameter of 2,000 mm. The atmosphere in the chamber was a helium atmosphere at 150 Torr.

We claim:

1. A powder manufacturing apparatus comprising:
a chamber;
a plurality of electrodes arranged in said chamber to be spaced from each other, at least one of said electrodes being a consumable electrode;
droplet forming means for generating an arc between said electrodes to melt a portion of the consumable electrode and thereby form droplets of a molten metal;
a disk aligned vertically with and below said portion of the consumable electrode and arranged to directly receive the droplets from the melting portion of the consumable electrode; and
disk rotating means for rotating said disk, to scatter and cool the droplets dropped on said disk, in order to form a powder.

2. An apparatus according to claim 1, wherein said chamber has a gas inlet port for introducing an inert gas.

3. An apparatus according to claim 1, wherein all chamber has a gas exhaust port for exhausting a gas therethrough.

4. An apparatus according to claim 1, wherein all of said electrodes comprise consumable electrodes.

5. An apparatus according to claim 1, wherein said electrodes comprise nonconsumable electrodes and consumable electrodes.

6. An apparatus according to claim 1, wherein a nonconsumable electrode is made of the same material as said consumable electrode and the sectional area of said nonconsumable electrode is set not less than twice that of said consumable electrode.

7. An apparatus according to claim 1, wherein said electrodes are arranged to be spaced from each other in the horizontal direction, and extending lines of axes of said respective electrodes coincide.

8. An apparatus according to claim 1, wherein at least one of said electrodes has a rotation driving means for rotating said electrode about an axis thereof.

9. An apparatus according to claim 1, wherein said electrodes have rotating means for rotating said electrodes about axes thereof in the same direction.

10. An apparatus according to claim 1, wherein said electrodes have rotating means for rotating said electrodes about axes thereof in opposite directions.

11. An apparatus according to claim 1, wherein said electrodes are arranged with distal ends thereof opposing each other and inclined downward such that extending lines of axes thereof intersect, and further comprising rotating means for rotating said electrodes about respective axes thereof.

12. An apparatus according to claim 1, wherein said apparatus is an apparatus for manufacturing a dispersion-reinforced metal powder, and said consumable electrode is a rod-like sintered body obtained by mixing a metal powder and a nonmetallic powder and sintering the mixture.

13. An apparatus according to claim 12, wherein said sintered body is obtained by mixing a Ni powder and a TiC powder and sintering the mixture.

14. An apparatus according to claim 1, wherein said consumable electrode is provided with an electrode driving means for moving said consumable electrode in a direction toward a distal end thereof, in accordance with a melted amount of said distal end, thereby maintaining constant a gap between said electrodes.

15. An apparatus according to claim 1, wherein said droplet forming means comprises a high frequency alternating current power source for generating an arc between said electrodes.

16. An apparatus according to claim 15, wherein said high frequency alternating current power source generates a high frequency wave of not less than 500 Hz.

17. An apparatus according to claim 15, wherein said high frequency alternating current power source generates a rectangular wave.

18. An apparatus according to claim 1, wherein said disk has an annular side wall projecting from a periphery of an upper surface thereof on which the droplets of the molten metal drop.

19. An apparatus according to claim 18, wherein an inner diameter of said disk inside said side wall is 50 to 200 mm when a rotational frequency of said disk is 15,000 to 30,000 rpm and when a particle size of a powder to be obtained is not more than 200 μm.

20. An apparatus according to claim 18, wherein a height of said side wall of said disk is 10 to 100 mm.

21. An apparatus according to claim 1, wherein said disk is made of a material selected from the group consisting of graphite, boron nitride, zirconium boride ($ZrB_2$), water-cooled copper, and stainless steel.

22. An apparatus according to claim 1, wherein said apparatus is a powder manufacturing apparatus for manufacturing a titanium or titanium alloy powder, and said disk is made of the same material as that of said powder.

23. An apparatus according to claim 1, wherein a partitioning wall is provided in said chamber, to define a space for forming droplets by the arc between said electrodes, and a space for scattering and cooling the droplets, and a communicating portion for allowing the droplets to pass therethrough and having a ventilation resistance provided in said partitioning wall.

24. An apparatus according to claim 23, wherein said droplet forming space is kept at a high vacuum pressure of not more than 50 Torr.

25. An apparatus according to claim 23, wherein said droplet forming space is kept at a high vacuum pressure of not more than 10 Torr.

26. An apparatus according to claim 23, wherein said space for scattering and cooling the droplets is kept at a low vacuum pressure of not less than 50 Torr.

27. An apparatus according to claim 23, wherein said space for scattering and cooling the droplets is kept at a low vacuum pressure of not less than 100 Torr.

28. An apparatus according to claim 23, wherein said communicating portion is provided in a path along which the droplets formed between said distal end portions of said electrodes drop on said disk.

29. An apparatus according to claim 23, wherein said communicating portion is provided in a path along which the droplets are scattered from said disk.

30. An apparatus according to claim 1, further comprising magnetic field generating means for applying a horizontal magnetic field to an arc generated between said electrodes, in directions perpendicular to the arc in order to sandwich the arc, and for causing a vertical downward force to act on the dropping droplets.

31. An apparatus according to claim 30, wherein said magnetic field generating means applies a direct current magnetic field when a direct current voltage is applied to said electrodes.

32. An apparatus according to claim 30, wherein when said magnetic field generating means applies an alternating current voltage to said electrodes, said magnetic field generating means applies an alternating current magnetic field of a phase locked with that of said alternating current voltage to said electrodes.

33. A method of manufacturing a powder, comprising the steps of:

placing a plurality of electrodes in a chamber to be spaced from each other, at least one of said plurality of electrodes being a consumable electrode;

generating an arc between said electrodes by applying a voltage between said electrodes, and forming droplets of a molten metal from a distal end portion of said consumable electrode;

aligning a disk vertically with and below said distal end portion of the consumable electrode; and rotating said disk having an upper surface thereof, causing the droplets to drop on said upper surface of said disk directly from said distal end portion of the consumable electrode, and scattering the dropped droplets by means of centrifugal force of said disk, thereby cooling the droplets.

34. A method according to claim 33, wherein an interior of said chamber is maintained at a reduced pressure.

35. A method according to claim 33, wherein an interior of said chamber is maintained to be an inert gas atmosphere.

36. A method according to claim 33, wherein at least said one of said electrodes is rotated about an axis thereof.

37. A method according to claim 33, wherein all of said electrodes are rotated about respective axes thereof.

38. A method according to claim 37, wherein the rotating directions of said electrodes are the same.

39. A method according to claim 37, wherein the rotating directions of said electrodes are opposite to each other.

40. A method according to claim 33, wherein said method is a method for manufacturing a dispersion-reinforced metallic powder and further comprises, prior to the step of placing said electrodes, a step of mixing metallic and nonmetallic powders and sintering the resultant mixture to form a rod-like consumable electrode.

41. A method according to claim 33, wherein the step of forming the droplets of the molten metal at the distal end portion of said consumable electrode comprises a step of controlling the movement of said consumable electrode in a direction toward said distal end thereof, in accordance with a melted amount of said consumable electrode, thereby maintaining constant a gap between said electrodes.

42. A method according to claim 33, wherein a high frequency voltage is applied between said electrodes to generate the arc.

43. A method according to claim 33, wherein the high frequency is not less than 500 Hz.

44. A method according to claim 33, wherein the high frequency wave is a rectangular wave.

45. A method according to claim 33, wherein said disk is rotated at a rotational frequency of 15,000 to 30,000 rpm.

46. A method according to claim 33, wherein a space for forming the droplets by the arc between said electrodes is maintained at a high vacuum pressure of not more than 50 Torr and a space for scattering and cooling the droplets by rotation of said disk is maintained at a low vacuum pressure of not less than 50 Torr.

47. A method according to claim 33, wherein a space for forming the droplets by the arc between said electrodes is maintained at a high degree of vacuum of not more than 10 Torr and a space for scattering and cooling the droplets by rotation of said disk is maintained at a low degree of vacuum of not less than 100 Torr.

48. A method according to claim 33, wherein a horizontal magnetic field is applied to said electrodes, in a direction perpendicular to the arc, thereby applying a vertical downward force to the dropping droplets.

49. A method according to claim 48, wherein a direct current magnetic field is applied to an arc which is generated when a direct current voltage is applied to said electrodes.

50. A method according to claim 48, wherein an alternating current magnetic field is applied to an arc which is generated when an alternating current voltage is applied to said electrodes, the alternating current magnetic field having a phase locked with that of the alternating current voltage.

51. A powder manufacturing apparatus comprising:
a chamber;
a plurality of electrodes arranged in said chamber to be distant from each other, at least one of said electrodes being a consumable electrode and another of said electrodes being a nonconsumable electrode that is made of the same material as said consumable electrode, the sectional area of said nonconsumable electrode being set to be not less than twice that of said consumable electrode;
droplet forming means for forming droplets of a molten metal by generating an arc between said electrodes;
a disk arranged at a location on which the droplets drop; and
disk rotating means for rotating said disk, to scatter and cool the droplets dropped on said disk, in order to form a powder.

52. A powder manufacturing apparatus comprising:
a chamber;
a plurality of electrodes arranged in said chamber to be distant from each other, at least one of said electrodes being a consumable electrode, wherein said plurality of electrodes are arranged with distal ends thereof opposing each other and inclined downward such that extending lines of axes thereof intersect;
droplet forming means for forming droplets of a molten metal by generating an arc between said electrodes;
a disk arranged at a location on which the droplets drop;
disk rotating means for rotating said disk, to scatter and cool the droplets dropped on said disk, in order to form a powder; and
rotating means for rotating said electrodes about respective axes thereof.

53. A powder manufacturing apparatus for manufacturing a dispersion-reinforced metal powder, comprising:
a chamber;
a plurality of electrodes arranged in said chamber to be distant from each other, at least one of said electrodes being a consumable electrode that is a rod-like sintered body obtained by mixing a metal powder and a nonmetallic powder and sintering the mixture;
droplet forming means for forming droplets of a molten metal by generating an arc between said electrodes;
a disk arranged at a location on which the droplets drop; and
disk rotating means for rotating said disk, to scatter and cool the droplets dropped on said disk, in order to form a powder.

54. An apparatus according to claim 53, wherein said sintered body is obtained by mixing a Ni powder and a TiC powder and sintering the mixture.

55. A powder manufacturing apparatus comprising:
a chamber;
a plurality of electrodes arranged in said chamber to be distant from each other, at least one of said electrodes being a consumable electrode;
droplet forming means, including a high frequency alternating current power source, for forming droplets of a molten metal by generating an arc between said electrodes;
a disk arranged at a location on which the droplets drop; and
disk rotating means for rotating said disk, to scatter and cool the droplets dropped on said disk, in order to form a powder.

56. An apparatus according to claim 55, wherein said high frequency alternating current power source generates a high frequency wave of not less than 500 Hz.

57. An apparatus according to claim 55, wherein said high frequency alternating current power source generates a rectangular wave.

58. A powder manufacturing apparatus comprising:
a chamber;
a plurality of electrodes arranged in said chamber to be distant from each other, at least one of said electrodes being a consumable electrode;
droplet forming means for forming droplets of a molten metal by generating an arc between said electrodes;
a disk arranged at a location on which the droplets drop and made of a material selected from the group consisting of graphite, boron nitride, zirconium boride ($ZrB_2$), water-cooled copper, and stainless steel; and
disk rotating means for rotating said disk, to scatter and cool the droplets dropped on said disk, in order to form a powder.

59. A powder manufacturing apparatus for manufacturing a titanium or titanium alloy powder, comprising:
a chamber;
a plurality of electrodes arranged in said chamber to be distant from each other, at least one of said electrodes being a consumable electrode;
droplet forming means for forming droplets of a molten metal by generating an arc between said electrodes;
a disk arranged at a location on which the droplets drop and made of the same material as that of said powder; and
disk rotating means for rotating said disk, to scatter and cool the droplets dropped on said disk, in order to form a powder.

60. A powder manufacturing apparatus comprising:
a chamber;
a plurality of electrodes arranged in said chamber to be distant from each other, at least one of said electrodes being a consumable electrode;
droplet forming means for forming droplets of a molten metal by generating an arc between said electrodes;
a disk arranged at a location on which the droplets drop; and
disk rotating means for rotating said disk, to scatter and cool the droplets dropped on said disk, in order to form a powder;
wherein a partitioning wall is provided in said chamber, to define a space for forming droplets by the arc between said electrodes, and a space for scattering and cooling the droplets, and a communicating portion for allowing the droplets to pass therethrough and having a ventilation resistance provided in said partitioning wall.

61. An apparatus according to claim 60, wherein said droplet forming space is kept at a high vacuum pressure of not more than 50 Torr.

62. An apparatus according to claim 60, wherein said droplet forming space is kept at a high vacuum pressure of not more than 10 Torr.

63. An apparatus according to claim 60, wherein said space for scattering and cooling the droplets is kept at a low vacuum pressure of not less than 50 Torr.

64. An apparatus according to claim 60, wherein said space for scattering and cooling the droplets is kept at a low vacuum pressure of not less than 100 Torr.

65. An apparatus according to claim 60, wherein said communicating portion is provided in a path along which the droplets formed between said distal end portions of said electrodes drop on said disk.

66. An apparatus according to claim 60, wherein said communicating portion is provided in a path along which the droplets are scattered from said disk.

67. A powder manufacturing apparatus comprising:

a chamber;

a plurality of electrodes arranged in said chamber to be distant from each other, at least one of said electrodes being a consumable electrode;

droplet forming means for forming droplets of a molten metal by generating an arc between said electrodes;

a disk arranged at a location on which the droplets drop; and disk rotating means for rotating said disk, to scatter and cool the droplets dropped on said disk, in order to form a powder; and magnetic field generating means for applying a horizontal magnetic field to an arc generated between said electrodes, in directions perpendicular to the arc in order to sandwich the arc, and for causing a vertical downward force to act on the dropping droplets.

68. A method of manufacturing a dispersion-reinforced metallic powder, comprising the steps of:

mixing metallic and nonmetallic powders and sintering the resultant mixture to form a rod-like consumable electrode;

placing a plurality of electrodes in a chamber to be distant from each other, at least one of said plurality of electrodes being said consumable electrode;

generating an arc between said electrodes by applying a voltage between said electrodes, and forming droplets of a moltenmetal from a distal end portion of said consumable electrode; and rotating a disk having an annular side wall projecting from a periphery of an upper surface thereof, causing the droplets to drop on said upper surface of said disk, and scattering the dropped droplets by means of centrifugal force of said disk, thereby cooling the droplets.

69. A method of manufacturing a powder, comprising the steps of:

placing a plurality of electrodes in a chamber to be distant from each other, at least one of said plurality of electrodes being a consumable electrode;

generating an arc between said electrodes by applying a high frequency voltage between said electrodes, and forming droplets of a moltenmetal from a distal end portion of said consumable electrode; and rotating a disk having an annular side wall projecting from a periphery of an upper surface thereof, causing the droplets to drop on said upper surface of said disk, and scattering the dropped droplets by means of centrifugal force of said disk, thereby cooling the droplets.

70. A method of manufacturing a powder, comprising the steps of:

placing a plurality of electrodes in a chamber to be distant from each other, at least one of said plurality of electrodes being a consumable electrode;

generating an arc between said electrodes by applying a high frequency voltage not less than 500 Hz between said electrodes, and forming droplets of a moltenmetal from a distal end portion of said consumable electrode; and rotating a disk having an annular side wall projecting from a periphery of an upper surface thereof, causing the droplets to drop on said upper surface of said disk, and scattering the dropped droplets by means of centrifugal force of said disk, thereby cooling the droplets.

71. A method of manufacturing a powder, comprising the steps of:

placing a plurality of electrodes in a chamber to be distant from each other, at least one of said plurality of electrodes being a consumable electrode;

generating an arc between said electrodes by applying a high frequency, rectangular wave of voltage between said electrodes, and forming droplets of a moltenmetal from a distal end portion of said consumable electrode; and rotating a disk having an annular side wall projecting from a periphery of an upper surface thereof, causing the droplets to drop on said upper surface of said disk, and scattering the dropped droplets by means of centrifugal force of said disk, thereby cooling the droplets.

72. A method of manufacturing a powder, comprising the steps of:

placing a plurality of electrodes in a chamber to be distant from each other, at least one of said plurality of electrodes being a consumable electrode;

generating an arc between said electrodes by applying a voltage between said electrodes, and forming droplets of a moltenmetal from a distal end portion of said consumable electrode; and rotating a disk having an annular side wall projecting from a periphery of an upper surface thereof, causing the droplets to drop on said upper surface of said disk, and scattering the dropped droplets by means of centrifugal force of said disk, thereby cooling the droplets, wherein said disk is rotated at a rotational frequency of 15,000 to 30,000 rpm.

73. A method of manufacturing a powder, comprising the steps of:

placing a plurality of electrodes in a chamber to be distant from each other, at least one of said plurality of electrodes being a consumable electrode;

generating an arc between said electrodes by applying a voltage between said electrodes, and forming droplets of a moltenmetal from a distal end portion of said consumable electrode;

rotating a disk having an annular side wall projecting from a periphery of an upper surface thereof, causing the droplets to drop on said upper surface of said disk, and scattering the dropped droplets by means of centrifugal force of said disk, thereby cooling the droplets; and maintaining a space for forming the droplets by the arc between said electrodes at a high vacuum pressure of not more than 50 Torr, and maintaining a space for scattering and cooling the droplets by rotating of said disk at a low vacuum pressure of not less than 50 Torr.

74. A method of manufacturing a powder, comprising the steps of:

placing a plurality of electrodes in a chamber to be distant from each other, at least one of said plurality of electrodes being a consumable electrode;

generating an arc between said electrodes by applying a voltage between said electrodes, and forming droplets of a moltenmetal from a distal end portion of said consumable electrode;

rotating a disk having an annular side wall projecting from a periphery of an upper surface thereof, causing the droplets to drop on said upper surface of said disk, and scattering the dropped droplets by means of centrifugal force of said disk, thereby cooling the droplets; and maintaining a space for forming the droplets by the arc between said electrodes at a high vacuum pressure of not more than 10 Torr, and maintaining a space for scattering and cooling the droplets by rotating of said disk at a low degree of vacuum of not less than 100 Torr.

75. A method of manufacturing a powder, comprising the steps of:

placing a plurality of electrodes in a chamber to be distant from each other, at least one of said plurality of electrodes being a consumable electrode;

generating an arc between said electrodes by applying a voltage between said electrodes, and forming droplets of a moltenmetal from a distal end portion of said consumable electrode;

rotating a disk having an annular side wall projecting from a periphery of an upper surface thereof, causing the droplets to drop on said upper surface of said disk, and scattering the dropped droplets by means of centrifugal force of said disk, thereby cooling the droplets; and applying a horizontal magnetic field to said electrodes, in a direction perpendicular to the arc, thereby applying a vertical downward force to the dropping droplets.

76. A method according to claim 75, wherein a direct current magnetic field is applied to an arc which is generated when a direct current voltage is applied to said electrodes.

77. A method according to claim 75, wherein an alternating current magnetic field is applied to an arc which is generated when an alternating current voltage is applied to said electrodes, the alternating current magnetic field having a phase locked with that of the alternating current voltage.

* * * * *